US006938896B2

(12) United States Patent
Tsuchida

(10) Patent No.: US 6,938,896 B2
(45) Date of Patent: Sep. 6, 2005

(54) AUTOMATIC CARD DISPENSING UNIT WITH DISPLAY CAPABILITY

(75) Inventor: Tamotsu Tsuchida, Iwatsuki (JP)

(73) Assignee: Asahi Seiko Co., Ltd, Tokyo (JP)

( * ) Notice: Subject to any disclaimer, the term of this patent is extended or adjusted under 35 U.S.C. 154(b) by 17 days.

(21) Appl. No.: 10/128,380

(22) Filed: Apr. 23, 2002

(65) Prior Publication Data

US 2002/0153657 A1 Oct. 24, 2002

(30) Foreign Application Priority Data

Feb. 22, 2001 (JP) ..... 2001-047225
Apr. 24, 2001 (JP) ..... 2001-126683
Sep. 3, 2001 (JP) ..... 2001-266461

(51) Int. Cl.[7] ..... A47F 1/10

(52) U.S. Cl. ..... 273/148 A; 372/148 R; 221/268; 271/107

(58) Field of Search ..... 273/148 A, 148 R; 221/2, 155, 210, 211, 258, 268, 103, 107, 149

(56) References Cited

U.S. PATENT DOCUMENTS 4,124,109 A * 11/1978 Bissell et al. ..... 194/210
4,377,285 A 3/1983 Kadlic
4,654,513 A 3/1987 Hennessy
4,750,743 A 6/1988 Nicoletti
4,787,533 A * 11/1988 Haroutel et al. ..... 221/12
4,993,587 A * 2/1991 Abe ..... 221/21
5,235,519 A * 8/1993 Miura ..... 700/233
5,301,834 A * 4/1994 Lee et al. ..... 221/129
5,452,221 A * 9/1995 Tumidei ..... 700/235
5,503,519 A * 4/1996 Schwetz et al. ..... 414/798.9
5,505,333 A * 4/1996 Shibazaki et al. ..... 221/155
5,605,249 A * 2/1997 Gonyea ..... 221/6
5,785,488 A * 7/1998 Raschke et al. ..... 414/798.9
6,626,426 B2 * 9/2003 Swinton et al. ..... 271/117

FOREIGN PATENT DOCUMENTS

JP 10-283525 10/1998

* cited by examiner

*Primary Examiner*—Vishu K. Mendiratta

(57) ABSTRACT

An automatic card dispenser unit for displaying and dispensing cards includes a storage housing for storing an array of cards. A holding member operatively positions a lower most card at a load station in a vertical alignment for display. A controller unit can receive a user input to dispense a card which will activate a dispenser assembly to cause a pickup member to removably grasp the card surface and release it from the holding member along a predetermined path of movement. A stopper member is mounted in the path of movement for separating the card from the pickup member to enable the card to be dispense to the user.

16 Claims, 8 Drawing Sheets

AUTOMATIC CARD DISPENSING UNIT WITH DISPLAY CAPABILITY

BACKGROUND OF THE INVENTION

1. Field of the Invention

Present invention provides an automated card dispensing unit that is capable of displaying a card to a user and dispensing the card upon the request of the user and more particularly for storing a stack of cards for viewing through a display window and for a grasping a surface of a displayed card and releasing it without obstructing the display feature.

2. Description of the Related Art

As labor costs have increased various forms of dispensing apparatus have been employed to automatically dispense items to users. For example, dispensing machines have, upon the insertion of monetary value by a user, dispensed telephone cards, subway tickets, bus tickets, prepaid credit cards, arcade game cards, novelty character cards, etc. Usually, the cards are thin rectangular objects with writing and/or display symbols placed on a face surface of the cards. The cards can be made from various materials such as a resin material, paper or metal or similar substances having an ability to retain indicia, a degree of flexibility and a size to be hand held. The term card is frequently used as a generic descriptive term and it can be appreciated that other dispensable objects having value to enable a user to enjoy either the card itself or the services that can be provided by the card can be utilized.

Japanese Laid-open Patent Application No. 10-283525 is an example of a vending machine that can dispense monetary notes.

Kadlic, U.S. Pat. No. 4,377,285 and the Nicoletti, U.S. Pat. No. 4,750,743 disclose various storage dispensing devices for dispensing playing cards. The Hennessy, U.S. Pat. No. 4,654,513 discloses a newspaper vending machine.

As can be appreciated it is highly desirable for a vending machine for dispensing cards to be able to dispense different types of cards and to provide variations of the cards that are to be dispensed. Frequently such machines have displayed on their exterior a sample card or indicia representative of the card to be dispensed. If the cards that are to be utilized and dispensed from the machine are changed, the sample card and/or indicia must be changed to match the characteristics of the present card in the dispensing machine. Accordingly, there is desire to provide a highly economical an efficient automatic card dispenser unit that can provide current information on the card being dispensed to permit the user to purchase or choose an individual card in a convenient manner.

SUMMARY OF THE INVENTION

An automatic card dispenser unit for displaying and dispensing cards is provided. The automatic card dispensing unit can be integrated into a vending machine or can be a modular unit that is adaptable for installing within a vending machine having an appropriate window to permit the display of cards. A storage housing can store a plurality of cards preferably in a vertical alignment in such a manner that may be urged in an array environment to a display position against a holding member that can position one of the plurality of cards for both display and at a loading position for dispensing. The automatic card dispensing unit can incorporate a micro processor based controller unit that can receive a user input to dispense a card and control a dispenser assembly wherein a motor can drive a pickup member to removable grasp the card surface at the loading position and to subsequently release it along a predetermined path of movement for dispensing to the user. Appropriate sensors can monitor the dispenser assembly while a stopper member can be mounted in a path of movement for separating a card from a pickup member to enable the card to be dispensed to the user. The stopper member is preferably transparent to facilitate the display of the card to the user and can further include a friction material to insure a positive release from the pickup device.

The controller unit can monitor the operation of the automatic card dispenser unit and can initiate a subsequent activation if the initial activation does not release a card. The controller unit can further indicate an error signal if the card dispenser unit malfunctions. Finally, the pickup member can mechanically capture and release a suspended card to insure an economical design.

BRIEF DESCRIPTION OF THE DRAWINGS

The exact nature of this invention, as well as its objects and advantages, will become readily apparent upon reference to the following detailed description when considered in conjunction with the accompanied drawings in which like reference numerals designate like parts throughout the figures thereof, and wherein.

DETAILED DESCRIPTION OF THE PREFERRED EMBODIMENTS

The following description is provided to enable any person skilled in the art to make and use the invention, and sets forth the best modes contemplated by the inventor of carrying out his invention. Various modifications, however, will remain readily apparent to those skilled in the art, since the general principles of the present invention have been defined herein specifically to provide a machine for dispensing articles from a stack and displaying the same.

In the present invention the terminology card is used to describe the stacked array of items that are to be dispensed by the present invention. Thus, the term card is not limited to the preferred embodiments disclosed herein, but rather is used as a convenient manner of describing one of an array of objects that can be progressively displayed and dispensed for example, from a vending machine in an economical manner.

Figure 1:
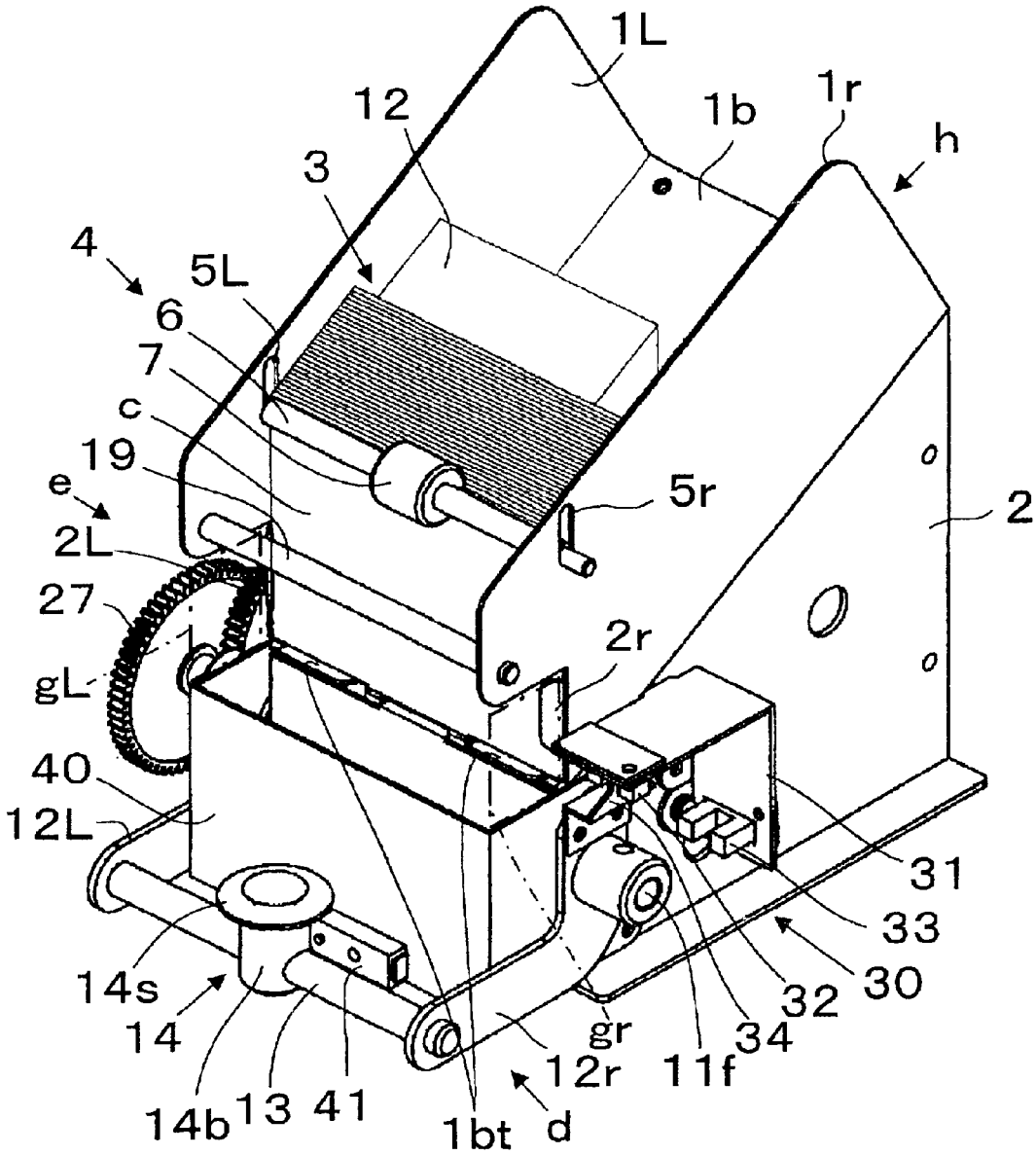
FIG. 1 is a perspective view of the first embodiment of the present invention from a right hand side view.
Figure 2:
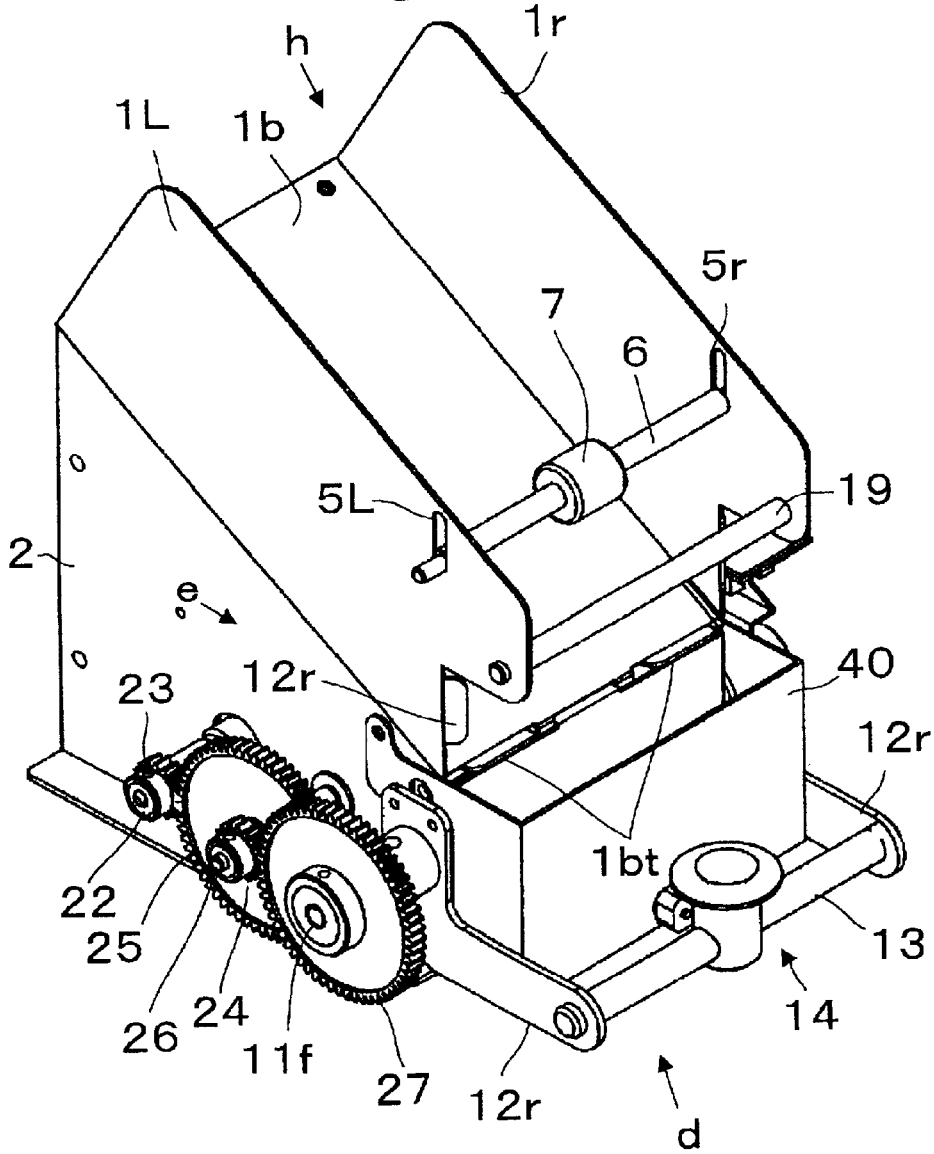
FIG. 2 is a perspective view without cards from a left-hand side view.

Referring to FIG. 1 a plurality cards, c, can be arrayed within an card holder h so that they can be displayed for viewing by the user and can then be subsequently dispensed by a dispenser assembly d. As can be seen in FIG. 1, the card holder h has a bottom plate 1*b* and a pair of vertical side boards 1L and 1*r*. The bottom plate 1*b* is incline to the horizontal to facilitate a gravity flow of the stacked array of vertical cards. The card holder h has a channel like shape with the first side board 1L and the second side board 1*r* vertically extending upward from the bottom plate 1*b*. A base frame 2 extends downward to a pair of lateral flanges which can be mounted within a vending machine.

The discharged end of the card holder or storage housing has the base board slightly slanted upwards at 1*bt* to facilitate the support of the lower most card of the array in a vertical alignment.

The lower ends of the side plates 1L and 1*r* can have an engaging or holding member or sections 2L and 2*r* protruding inwardly into the storage channel to facilitate a retention of the stacked vertical array of cards c. The first or head card is stopped and held by engagement with the sections 2L and 2*r*, while the remaining cards are arrayed behind the head card c in the card storage area 3 and positioned perpendicular to the horizontal. The positioning of the lower support surface 1*bt* and the side holding engagement parts 2L and 2*r* define a load or pickup position f. These features define a holding member e that can include an arranging device 4 that can comprise a shaft 6 and central roller 7.

The shaft 6 can have reduced or smaller shaft ends that can be inserted within vertically elongated holes 5L and 5*r*. The roller 7 that is fixed to the middle of the shaft 6 can be made of rubber with the position of the roller 7 located over the initial head card c at the pickup position f The surface of the roller 7 can have contact with the upper edge of the card c to align the card c in a load position.

Because the cards are stored in a perpendicular arrangement wherein the weight is borne by the base board 1*b* the cumulative weight or pressure from the plurality of cards arrayed behind the head card is relatively small and therefore prevents any damage to the cards.

Figure 3:
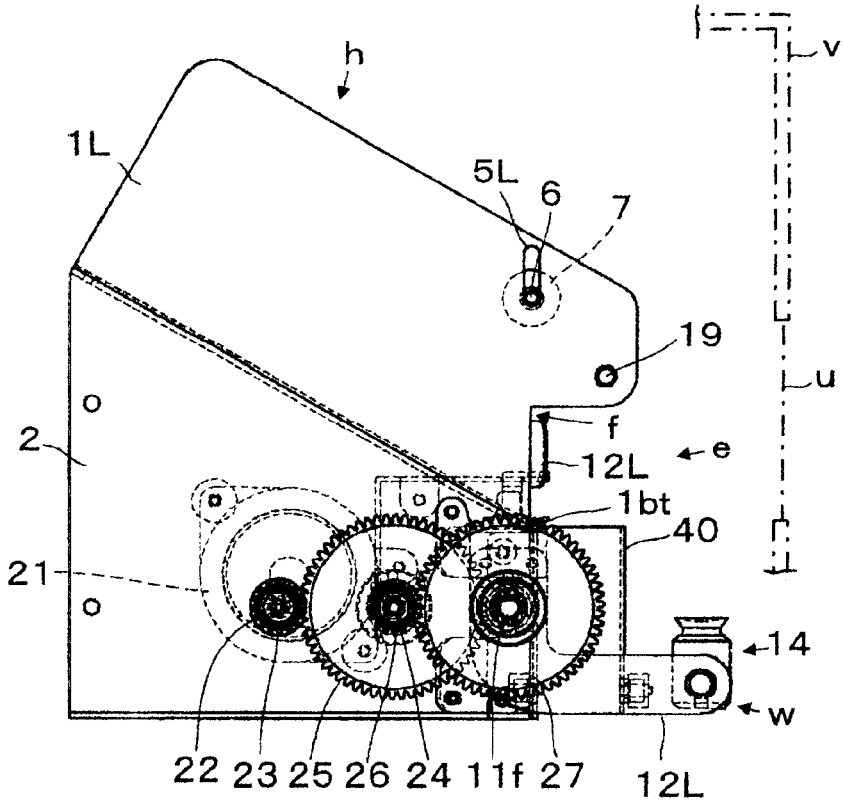
FIG. 3 is an elevated right hand side view.

Referring to FIG. 3, a schematic view of the housing of a vending machine v having a window u is disclosed. The window u permits a vertically standing card c to be viewed by the user so that the design of the card c and its content can be seen from outside of the vending machine. A stopper member 19 is positioned on an extended flange of the respective left 1L and 1*r* side channels. The stopper member 19 has a bar or rod like shape and is located in front of the end 1*bt* of the bottom plate 1*b*. The distance between the stopper member 19 and the end 1*bt* is smaller than the height of the card c. As can be seen, the stopper 19 extends across a viewing space in a vertical plane that is offset from a vertical plane containing the vertically aligned card c. As such, it is desirable that the stopper 19 be made of a transparent material so that it does not obstruct the view of the user. To further facilitate the gravity feed of the cards c, a weight member 12 can be located on the bottom plate 1*b* in the card storage area 3 to provide a force to push the array of cards downward to the loading position. Thus, the weight 12 will slide downward on the bottom plate 1*b* by gravity and the angular inclination of the bottom plate 1*b* is such to allow movement of the weight 12.

Figure 4:
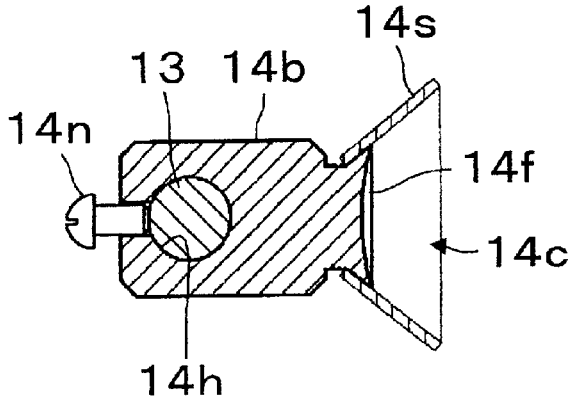
FIG. 4 is a cross sectional view of a pick up disk.

The dispensing device or assembly d includes a pair of arms 12L and 12*r* having an L like shape that are fixed for pivoting about the rotating shaft 11*f*. Shaft 11*f* is supported on the base plate 2. A supporting bar 13 is fixed to the respective ends of the first lever 12L and the second lever 12*r*. Mounted on the support bar 13 is a pickup member or disk 14 that is fixed to the middle portion of the support bar 13. A cross sectional view of the disk 14 can be seen in FIG. 4. The pickup disk 14 has a cylindrical body 14*b* which includes an end 14*t* which has a cone like shape and supports an extended disk 14*s* which has a ring like shape. The combination of the disk 14*s* and the end 14*t* define a space area 14*c*. The disk 14*s* can be made from a material which is smooth and flexible but which can withstand repetitive contact with a card member. Such a material can be a flexible polyurethane. The support bar passes through a mounting hole or bore 14*h* in the cylindrical body 14*b*. A screw 14*n* can be used to fix the cylinder body 14*b* to the supporting bar 13.

As shown, for example, in FIG. 3 the pickup member 14 can be rotated across a predetermined path between a pickup position f that permits an adhering of the pickup disk 14*s* of the card c and a standby position w which lies in horizontal plane in front of the card c. The standby position w is a position which can be achieved by rotation of the shaft 11*f* in a clockwise direction. In such a position the pickup member 14 is located below the end 1*bt* and away from the card c which is located at the load or pickup position f. When the pickup member 14 is moved between the standby position w and the pickup position f, the pickup member will be located between the end plate 1*bt* and the stopper 19.

Referring to FIG. 3, the driving device 21 which can be an electric motor for rotating the shaft 11*f* through a gear transmission comprising a pinion gear 23 mounted on the shaft 22 connected to the motor which intern contacts a gear 25 which rotates a pinion gear 26 which engages the gear 27 mounted on a shaft 11*f* The pinion gear 23 is fixed to the output shaft 22 of the motor 21 with a reducer which is fixed to the inner side of the base 2. Gears 25 and 26 are rotatable and fixed to the shaft 24, which is also fixed for rotation on the base 2.

Figure 5:
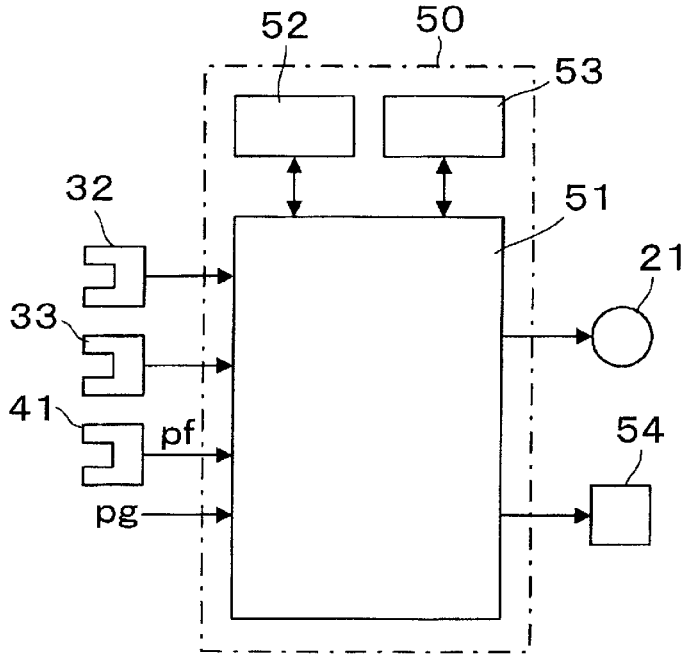
FIG. 5 is a block schematic diagram of the control circuit of the first embodiment.

Referring to FIGS. 1 and 5 a position detecting device 30 for the pickup member 14 includes a mounting bracket 31 of an L shape configuration that is fixed to the base plate 2. A stand by position sensor 32 and pickup position sensor 33 are also fixed to bracket 31. These sensors can for example, be a proximatity sensor, a photoelectric sensor or any other conventional sensor to monitor the position of the shaft 11*f* . In the preferred embodiment shown in FIG. 1, an extension member 34 fixed to an end of the second lever 12*r* can move between channels of the respective sensor positions 32 and 33. As shown in FIG. 1 if a first lever 12L and a second lever 12*r* are moved in a counter clockwise direction, the standby sensor 32 is switched on at the standby position w. When the respective levers are moved in the clockwise direction a pickup position sensor 33 is switched on at the pickup position f which is located so that the pickup member 14 will have a gripping contact with a card c.

Mounted below the end plate 1*bt* is a card guide member 40 which can be formed in a rectangular configuration and can be fixed to the base plate 2. Card guide 40 is located beneath the stopper 19 and is capable of receiving a card c that can be released from the pickup member 14 to permit a gravity transmission towards an opening of a vending machine. A card sensor 41 shown in FIG. 1 can be fixed to the base of the card guide 40 to measure the transporting of a card c through the card guide 40. This sensor 41 can be a transmission photoelectric sensor.

Referring to the schematic circuit in FIG. 5, the control device 50 can include a microprocessor comprising MPU 51, a RAM 52 and ROM 53. This control device can receives signals that are input from the standby position sensor 32, the pickup position sensor 33, a card sensor 41, and a dispensing signal pg that can be entered through an enter phase with the user. The motor 21 and a visual display 54, for example, on the exterior of the vending machine, can be controlled by the control device 50. The visual display 54 can indicate the status of the machine, the occasion of an error signal and can further provide operation information to the user.

Figure 6:
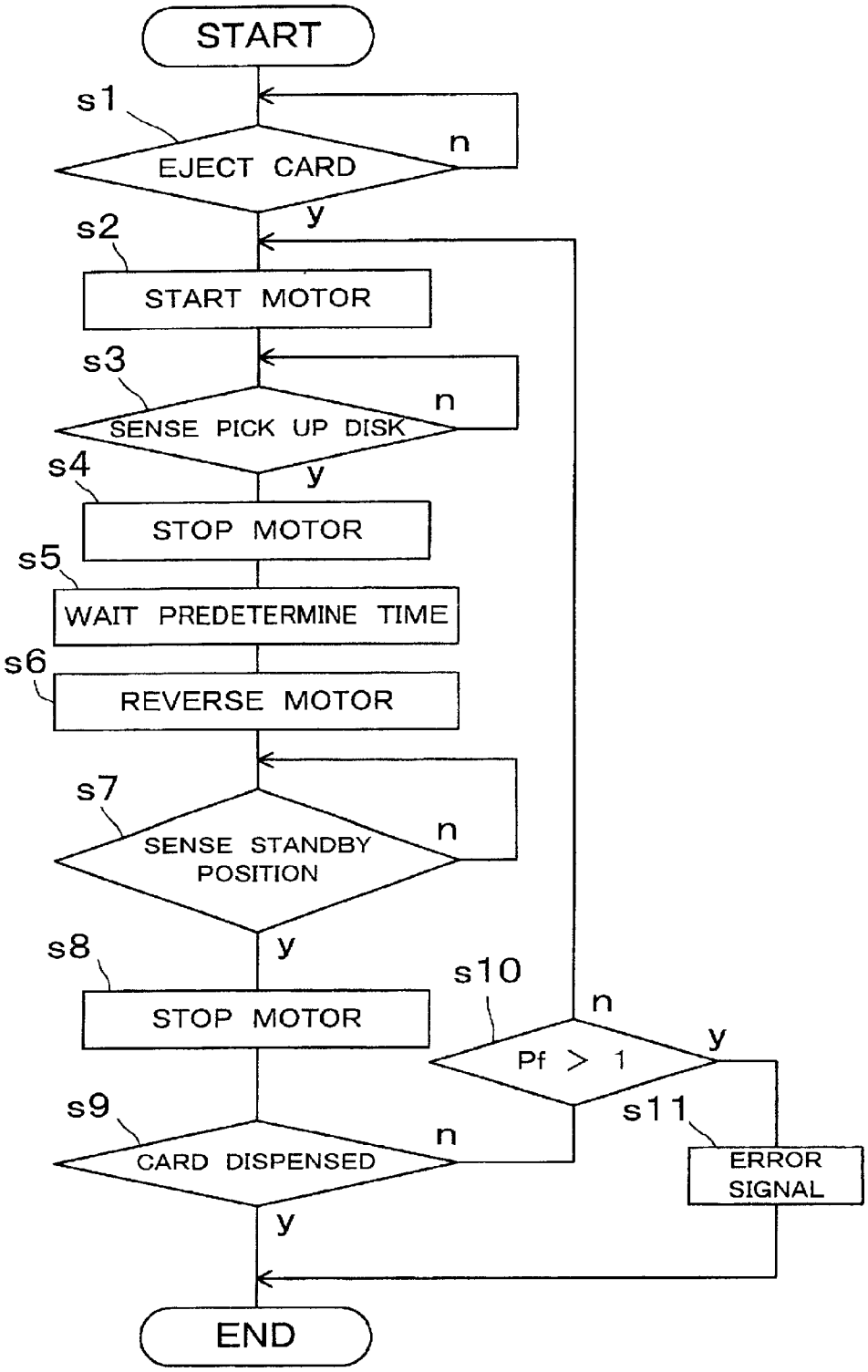
FIG. 6 is a flow chart explaining the operation of the first embodiment.
Figure 7:
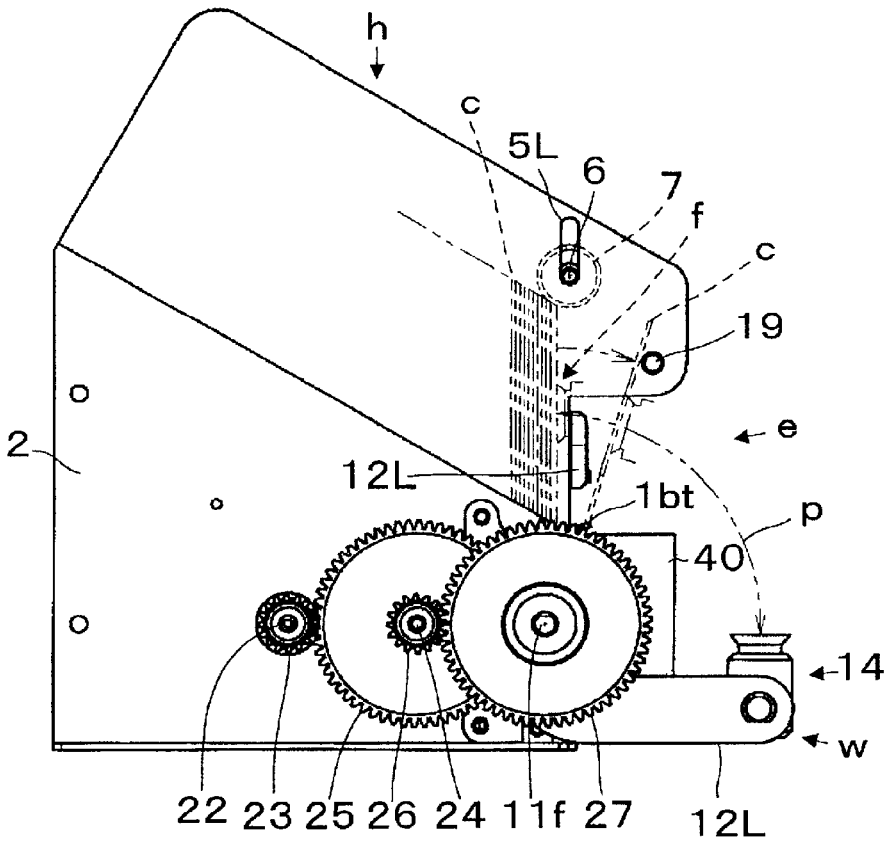
FIG. 7 is an elevated left-hand side explanatory view of the first embodiment.

Referring to FIGS. 6 and 7, the operation of the first embodiment can be explained. In a standby situation a card c is located at the storage area 3 in a load position above the base plate 1*bt*. In this position the lower most card is vertically aligned at the pickup position f and it engages the holding member formed by the respective left and right engagement pieces 2L and 2*r*. The roller 7 engages the top surface of the card and is movably mounted with respective ends of the shaft 6 mounted in the vertically elongated holes 5L and 5*r* to permit displacement when the card C is released. As can be seen from FIG. 3, the user can observe the surface of the card through an appropriate viewing window in the housing of the vending machine. A user that desires to secure the card can then activate the vending machine which will subsequently produce a dispensing signal pg which can be provided to the MPU 51. For example, the user can purchase a telephone card by dispensing monetary coins into the vending machine which in turn provides a dispensing signal pg. The MPU 51 then activates a control program in response to the dispensing signal pg as illustrated in FIG. 6.

The decisional step s1 indicates whether or not a dispensing signal pg for ejecting a card has been received. If it has been received, step 2 initiates the start of the motor 21 whereby the first arm 12L and the second arm 12*r* will rotate in a counter clockwise direction at the appropriate reduced speed as indicated by the arc path P shown in FIG. 7. The pickup member 14 will move upward toward the card c surface which is located at the load position. The pickup position sensor 33 detects the entrance of the operation piece 34 and provides a signal indicating the operative position of the pickup disk in step s3. The control signal then indicates in step s4 that the motor 21 has stopped. The center of the card surface of the card c surface is adhered by the vacuum depression of the space 14*c* so that it is now removably secure to the pickup member 14. The control program keeps the motor 21 in a stopped position for a predetermined time as shown in step s5 and then subsequently reverses the motor 21 in step s6 so that the respective first lever 12L and second lever 12*r* in the dispensing assembly rotates in the counter clockwise direction shown in FIG. 7. When the first lever 12L and the second lever 12*r* are moved to a horizontal level position the standby position sensor 32 detects the operating piece 34 and outputs an appropriate signal as shown in step s7. The motor then is stopped at step s8. During this movement the center of the card c is sufficiently adhered by the pickup device 14 so that the card c is bent in a curved or arched like shape to permit the right and left end of the card c to release from the holding members 2*r* and 2L. The width of card is narrowed by bending and the card c will pass through and will be released from the first stopper 2L and the second stopper 2*r*. The subsequent card c in the stacked array will slide downward under the force of the weight 12 to again engage at a load position the first stopper 2L and the second stopper 2*r*.

The card that has been attached to the pickup member 14 will contact the end 1*bt* and it will also contacts the stopper member 19. The pickup member 14 will be released and as a result the card c is released and will bounce back by a reaction and will also be released from the end 1*bt* so that it will then fall down the card guide 40 and will be guided to a exit position for delivery to the user. If in the case that the lower end of the drawn card is released from the end 1*bt* and has contact with the upper end of the card guide 40 the card c will be stopped by the upper end of the card guide 40 and the stopper 19 and the pickup disk 14 is also easily moved away from the card c so that it is released and guided to an article exit.

As the card c falls through the card guide 40 the card sensor 41 can sense the passage of the card c and can output a detecting signal pf. Referring again to FIG. 6 if the dispensing of the card is detected at step s9, the dispensing process is finished. If, however, the signal pf is not confirmed in step s9, the control process advances to a step s10 to make a determination whether the output of the signal pf has occurred twice. If the signal pf occurs only once the control program is returned to step s2 and the process of attempting to remove the card c is retried. When the signal pf is received twice an output signal can be provided as shown in step s11 to output an abnormal signal and the system can shut down. The abnormal signal can be displayed for example, in a visual display 54 such as an LCD.

The present invention can be modified within the scope and spirit of the present disclosure. For example, the bottom plate 1*b* of the card holder h can be located at a horizontal level position rather than being inclined and therefore the weight 12 would be replaced with a spring bias plate for urging the array of cards forward to the vertical load position. As an additional modification, the pickup member 14 can have an auxiliary suction source to help adhere to the surface of card c.

It is also possible to have a first guide plate gL located in an area between the first side board 1L and the card guide 40 and a second guide plate gr located in an area between the second side board 1*r* to provide a card guide as shown by the dotted line in FIG. 1. Therefore, if the card c happens to bounce and slip away, the card c is guided by the first guide board gl and the second guide board gr and is guided to the card guide 40.

Figure 8:
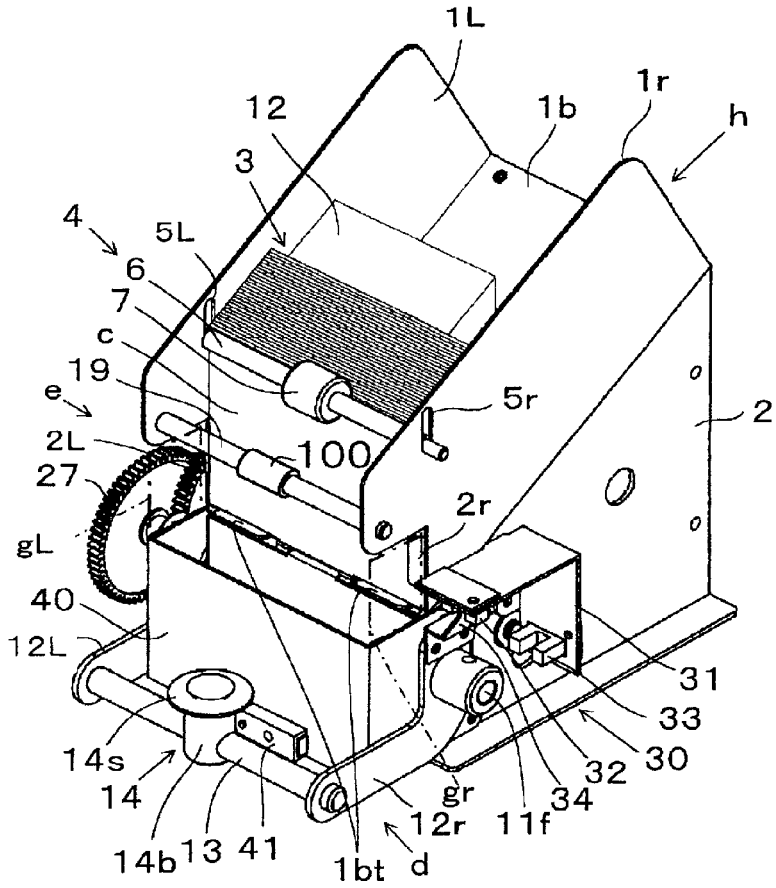
FIG. 8 is a right hand perspective view of a second embodiment of the present invention.

Referring to FIG. 8, a second embodiment of the present invention is disclosed. Basically, the structure in the second embodiment is similar to that of the first embodiment and only those components that differ from the first embodiment will be explained.

The stopper 19 can be covered by a tube 100 to provide a high friction section. The tube 100 can be made for example, from a silicone gum material which can be highly transparent thereby still permitting the card c to be seen by the purchaser or user through the vending machine display window. Alternatively, the tube 100 can be made from a polyurethane or MBR which are not as highly transparent.

The high friction section tube can be formed by providing a powder like gum directly to the surface of the stopper 19 and further the stopper 19 could have embossed on its surface a predetermined uneven structure or friction surface.

In the operation of the second embodiment when the first lever 12L and the second 12*r* move in a counter clockwise direction to the level position it performs the same function as set forth in step 7 of the first embodiment. When the pickup device 14 contacts the card at the load position and the motor 21 is reversed the lower edge of the card c that is being drawn from the array is stopped by the end 1*bt* and the upper edge is stopped by the stopper 19. In this situation the card c is held by the end 1*bt* and is in contact with the friction surface of the tube 100 on the stopper 19. As the pickup member 14 further is retracted the upper section of the card c has contact with the high friction section and accordingly will not slip from the tube 100. Additionally, the card c can not be bent, as a result the pickup member 14 will break away from the card c because the holding force at the end 1*bt* and the stopper 19 becomes larger than the pickup force exerted by the pickup member 14. Therefore, the card c will fall into the card guide 40 and be guided to the article exit.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. An automated card dispenser unit for displaying and dispensing cards from a vending system, comprising:

a vending machine having a display window to enable a user to view a card to be dispensed;

a storage housing for storing a plurality of cards within the vending machine;

a holding member operatively connected to the storage housing for positioning one of the plurality of cards at a position that can display, in a vertical plane, a card surface through the display window;

a controller unit on the vending machine for receiving a user input to dispense a card;

a dispenser assembly for receiving a signal from the controller unit to dispense a card including a pickup member for removably grasping the card surface and releasing it from the holding member along a predetermined path of movement; and a stopper member mounted in the path of movement for separating the card from the pickup member to enable the card to be dispensed to the user, wherein the dispenser assembly rotates the pickup member from a horizontal rest position below the holding member to a vertical position adjacent the holding member to engage the pickup member within the card and retracts the pickup member to initially release the card from the holding member and subsequently to contact the card with the stopper member.

2. The automatic card dispenser unit of claim 1, wherein the stopper member is positioned in a second vertical plane offset and parallel to the vertical plane containing the card and within the display space for the card.

3. The automatic card dispenser unit of claim 2, wherein the stopper member is transparent.

4. The automatic card dispenser unit of claim 1, wherein the stopper member includes a friction member for contacting the card.

5. The automatic card dispenser unit of claim 4, wherein the friction member is made from a silicone gum material.

6. The automatic card dispenser unit of claim 1, wherein the storage housing mounts the plurality of cards in a stacked vertical alignment.

7. An automated card dispenser unit for displaying and dispensing cards from a vending machine, comprising:

a vending machine having a display window to enable a user to view a card to be dispensed;

a storage housing for storing a plurality of cards within the vending machine;

a holding member operatively connected to the storage housing for positioning one of the plurality of cards at a position that can display a card surface through a display window; and a controller unit on the vending machine for receiving a user input to dispense a card, wherein the dispenser assembly includes a pickup member which moves between a standby position and a pickup position, and further includes a stopper member positioned between the standby position and the pickup position, the holding member positions the card in a vertical plane for display, and the dispenser assembly rotates the pickup member from a horizontal standby position below the holding member to a vertical pickup position adjacent the holding member to engage the pickup member within the card and retracts the pickup member within the card and retracts the pickup member to initially release the card from the holding member and subsequently to contact the card with the stopper member.

8. The automatic card dispensing unit of claim 7 wherein the holding member includes a roller member movably mounted to be displaced upward when the card is released.

9. An automatic card dispenser unit for displaying and dispensing cards, comprising:

a frame;

a storage housing for storing a plurality of cards vertically for display, which is attached to the frame, wherein the cards slide a predetermined direction downwards on a base of the storage housing;

a holding member which is operatively connected to the storage housing for positioning one of the plurality of cards at a position that displays a card surface to a user;

a rotating shaft which crosses a predetermined sliding direction of the cards at a right angle and is attached to the frame;

an arm which is fixed to the rotating shaft;

a supporting bar which is fixed to the arm;

a plate which is located at a lower edge of the base of the storage housing;

a stopper member which is located over and the plate and is attached to the frame;

a card guide which is located below the plate and the stopper member and is attached to the frame, adjacent a card falling passageway;

a pickup disc which is fixed on the supporting bar, and is cone-like in shape, at least some part of a pickup disc is made from a flexible material, the pickup disc reciprocates between a standby position and a pickup position which pushes the cards through the plate and the stopper member, the space between the plate and the stopper is larger than the pickup disc and is smaller than the cards;

a motor rotates in a forward direction and a reverse direction to drive the rotating shaft, the motor is located below the card guide and is attached to the frame; and a controller unit for receiving a user input to dispense a card and for driving the motor, wherein when the motor rotates in the forward direction, the pickup disc moves from the standby position to the pickup position and pushes the cards based on the rotation of the shaft, and the flexible material of the pickup disc is deformed so that the card is attached by the pickup disc, afterwards the motor rotates in the reverse direction whereby the pickup disc returns to the standby position, in this movement, the attached card is initially stopped by the plate and the stopper member, and the card is released from the pickup disc and falls down through the card guide.

10. The automatic card dispenser unit of claim 9, wherein the stopper member is transparent.

11. The automatic card dispenser unit of claim 9, wherein the stopper member includes a friction member for contacting the card.

12. The automatic card dispenser unit of claim 11, wherein the friction member is made from a silicone gum material.

13. An automated card dispenser unit for displaying and dispensing cards from a vending system, comprising:

a vending machine having a display window to enable a user to view a card to be dispensed;

a storage housing for storing a plurality of cards within the vending machine;

a holding member operatively connected to the storage housing for positioning one of the plurality of cards at a position that can display a card surface through the display window, the holding member includes a roller member movably mounted to be displaced upward when the card is released;

a controller unit on the vending machine for receiving a user input to dispense a card;

a dispenser assembly for receiving a signal from the controller unit to dispense a card including a pickup member for removably grasping the card surface and releasing it from the holding member along a predetermined path of movement; and a stopper member mounted in the path of movement for separating the card from the pickup member to enable the card to be dispensed to the user.

14. The automatic card dispenser unit of claim 13, wherein the stopper member is transparent.

15. The automatic card dispenser unit of claim 13, wherein the holding member positions the card in a vertical plane for display.

16. The automatic card dispenser unit of claim 15, wherein the dispenser assembly rotates the pickup member from a horizontal rest position below the holding member to a vertical position adjacent the holding member to engage the pickup member within the card and retracts the pickup member to initially release the card from the holding member and subsequently to contact the card with the stopper member.

* * * * *